United States Patent [19]

Evans

[11] Patent Number: 4,960,508

[45] Date of Patent: Oct. 2, 1990

[54] TWO-STEP HETEROCYCLIC NITROGEN EXTRACTION FROM PETROLEUM OILS

[75] Inventor: Wayne E. Evans, Richmond, Tex.

[73] Assignee: Shell Oil Company, Houston, Tex.

[21] Appl. No.: 303,334

[22] Filed: Jan. 30, 1989

[51] Int. Cl.[5] ..... C10G 17/04

[52] U.S. Cl. ..... 208/254 R; 208/282; 208/312; 208/316

[58] Field of Search ..... 208/312, 321, 315, 316, 208/329, 282, 254 R

[56] References Cited

U.S. PATENT DOCUMENTS

| | | | |
|---|---|---|---|
| 1,686,136 | 10/1928 | Ihrig . | |
| 2,263,175 | 11/1941 | Lazar et al. | 208/282 |
| 2,263,175 | 11/1941 | Lazar et al. | 260/269 |
| 2,263,276 | 11/1941 | Lazar et al. | 260/269 |
| 2,352,236 | 6/1944 | Thomas | 196/39 |
| 2,779,709 | 1/1957 | Dale et al. | 208/321 |
| 4,272,361 | 6/1981 | Campton | 208/282 X |
| 4,332,675 | 6/1982 | Baset | 208/254 R |
| 4,332,676 | 6/1982 | Baset | 208/254 R |
| 4,409,092 | 10/1983 | Johnson et al. | 208/89 |
| 4,426,280 | 1/1984 | Chen et al. | 208/254 R |
| 4,623,444 | 1/1986 | Che et al. | 208/282 X |
| 4,671,865 | 6/1987 | Madgavkar et al. | 208/96 |

*Primary Examiner*—Glenn Caldarola

*Attorney, Agent, or Firm*—Pamela J. McCollough

[57] ABSTRACT

A process for the removal of basic heterocyclic nitrogen compounds from petroleum oils which comprises:

(a) contacting said petroleum oils containing basic heterocyclic nitrogen compounds with an aqueous solution of a first solvent comprising concentrated acid at extraction conditions in a first extract zone, (b) separating the product of step (a) into a raffinate product stream comprising hydrocarbons having a lean content of basic heterocyclic nitrogen compounds and residual acid levels, and a first extract phase comprising hydrocarbons, water and acid having a substantial content of basic heterocyclic nitrogen compounds, (c) flashing said first extract phase to remove bulk first solvent.

(d) contacting said flashed first extract stream with an aqueous solution of a second solvent comprising a dilute acid in a second extraction zone, and (e) separating the product of step (d) into a recovery stream comprising hydrocarbons having a lean content of basic heterocyclic nitrogen compounds and a second extract phase comprising acid, water and a decreased amount of hydrocarbons and having a high content of basic heterocyclic nitrogen compounds.

28 Claims, 2 Drawing Sheets

TWO-STEP HETEROCYCLIC NITROGEN EXTRACTION FROM PETROLEUM OILS

FIELD OF THE INVENTION

The field of this invention resides in the removal of nitrogen compounds from fossil fuels, inclusive of petroleum oils. This invention seeks to remove basic nitrogen from high-nitrogen petroleum oils such as those derived from West Coast North American crudes.

Introduction

These nitrogen compounds create a major problem in downstream processing by deactivating cracking and hydroprocessing catalysts. Various prior methods have been employed for separating nitrogen compounds from petroleum oils, such as the use of gaseous sulfur dioxide and the use of inorganic acids.

Basic nitrogen compounds can be removed from oil by extraction with an acidic solvent. However, the process is usually less than 100% selective; some nitrogen-free hydrocarbon oil is also dissolved into the acidic phase. This nitrogen-free hydrocarbon oil will be rejected from the raffinate stream along with the high-nitrogen extract, and thus represents a loss of raffinate yield. Raffinate yield losses are particularly high, i.e., the selectivity of the process is particularly low, when a very high fraction of the basic nitrogen present in the oil must be removed. At "deep" basic nitrogen removal, the ratio of pure hydrocarbon to basic nitrogen remaining in the oil becomes very large, thus favoring the dissolution of nitrogen-free oil, rather than basic nitrogen, into the acidic phase. Further, as more and more basic nitrogen is removed, the basic nitrogen compounds remaining in the oil phase are, by definition, the least acid-soluble. In order for an extraction process to be commercially viable, the selectivity of the extraction process must be high, which is to say, losses of nitrogen-free hydrocarbon into the extract stream must be low.

This invention seeks to improve the selectivity of a basic nitrogen extraction process. When the process of the instant invention is utilized, the extract stream generated by the two-step extraction contains a higher fraction of basic nitrogen material and a lower fraction of pure hydrocarbons, relative to conventional basic nitrogen extraction processes. While it is not feasible to remove all nitrogen compounds from petroleum oils by an extraction process, it is preferred that the content of the nitrogen compounds be reduced to the practical minimum in order to reduce the poisoning of catalysts in downstream processing. As used herein, the term "petroleum oils" includes petroleum oils, shale oils and tar sand-derived oils.

The key aspect of this invention resides in a two-step extraction process. In the first step of the process, the basic nitrogen concentration of the feed is reduced by extraction with a concentrated acid solvent. The extract from this first step contains a high concentration of basic nitrogen, but may also contain a considerable amount of nitrogen-free oil. In the second step of the process, the extract from the first step is treated with a more dilute acid solvent, allowing said extract to be partitioned into a dilute-acid-insoluble phase that is relatively low in basic nitrogen content, but which contains most of the nitrogen-free oil that was present in the extract from the first step, and a dilute-acid-soluble phase that is very high in basic nitrogen content, but which contains very little nitrogen-free oil. Said dilute-acid-insoluble phase can be recycled, i.e. added back to the feed stream of the first step of the extraction process, or can be combined with the raffinate stream of the first step of the extraction process. Following solvent removal, the dilute-acid-soluble phase from the second step of the process constitutes the extract stream of the combined two-step process. Although the manner of utilizing this high-nitrogen extract stream is immaterial to this invention, it is likely that the extract stream will be of lower value than the denitrogenated raffinate stream.

The two-step process of the instant invention is superior to a single-step extraction with concentrated acid solvent because the selectivity of the two-step process is higher. Higher selectivity is equivalent to a higher yield of denitrogenated product raffinate.

Also, the two-step process of the instant invention is superior to a single-step extraction with dilute acid solvent because dilute acid treatment of a bulk feedstock generally cannot achieve deep removal of basic nitrogen. Further, a much larger volume of dilute acid is required to remove a given amount of basic nitrogen from a feedstock, as compared to the volume of concentrated acid required to remove the same amount of basic nitrogen from the same feedstock. Reduced solvent volume translates directly into reduced capital and operating expenses.

Background of the Invention

In addition to hydroprocessing, other techniques have been disclosed for the removal of nitrogen compounds. Recently, two U.S. patents issued to Baset, 4,332,676 and 4,332,675, which disclose a process for the removal of basic nitrogen compounds from organic streams inclusive of petroleum oils utilizing gaseous sulfur dioxide to thereby precipitate a salt comprising the basic nitrogen compound, sulfur dioxide and water with downstream separation of the precipitated salt. Both of these patents concern a single phase treatment system with an essentially water-free separation system in '675 and only enough water in '676 such that a single phase system is existent. In fact, in the latter reference, the addition of water is limited to a concentration only to the extent that a two-phase liquid system will never be formed. It is also disclosed that a non-polar solvent can be utilized in the the contacting step such as petroleum ether, a lower paraffinic hydrocarbon or an aromatic hydrocarbon such as toluene. While the types of basic organic nitrogen compounds extracted in the instant invention are either similar to or the same as those described in Column 2 of the '676 disclosure, the means by which the process is undertaken in the instant invention is very different from that disclosure.

In the October 1983 issue of *Chemical Engineering*, an article by Desai and Madgavkar recognized a method to remove nitrogen compounds from shale oil by solvent extraction with a formic acid/water solvent prior to hydrotreating. The advantage of this technique is a reduced hydrogen consumption and a reduction of the nitrogen content to a level that allows downstream processing of the shale oil.

The addition of inorganic acids to petroleum oils to reduce the quantity of nitrogen compounds has long been established. For example, in U.S. Pat. No. 2,352,236, anhydrous hydrogen chloride is added to improve a charge stock for catalytic cracking. A dilute acid, such as sulfuric acid, is disclosed in U.S. Pat. No.

1,686,136 to complex nitrogen compounds existent in a California-derived crude oil. Organic carboxylic acids, sometimes referred to as low molecular weight fatty acids of high volatility, have been used to complex nitrogen-bases in such disclosures as U.S. Pat. Nos. 2,263,175 and 2,263,176. While these latter two references employ a portion of the chemical mechanism utilized in the first step of this two-step nitrogen extraction process they fail to disclose, suggest or even hint at the use of a second extraction step with a dilute acid solvent to improve the selectivity of the process, which results in a higher overall yield of denitrogenated raffinate. Also, these references fail to teach the use of two extraction steps, one utilizing a concentrated acid solvent and one utilizing an acid solvent more dilute than the concentrated acid solvent utilized in the first extraction step.

A patent issued to Madgavkar et al, U.S. Pat. No. 4,671,865, discloses a two step process for removing heterocyclic nitrogen from petroleum oils. The patent describes the combination of hydrotreatment followed by acid extraction for removing nitrogen from petroleum oil.

U.S. Pat. No. 4,426,280 discloses the removal of nitrogen from shale oil by contacting an oil stream with a dilute acid followed by contacting the oil stream with a concentrated acid. The order of contacting acids is the reverse of that utilized in the instant invention.

A patent issued to Johnson et al, U.S. Pat. No. 4,409,092, in 1983 teaches formation of a high nitrogen fraction and a low nitrogen fraction, which is then subjected to phosphoric acid extraction. The fraction high in nitrogen content is catalytically cracked and then either hydrotreated or sent to phosphoric acid extraction. There is no disclosure by Johnson et al of a two-step extraction process whereby extraction of petroleum oil is made in the presence of a concentrated acid extraction agent and then subsequently the extract from the first extraction is extracted with a dilute acid, thus improving the overall yield of denitrogenated raffinate.

Thus, the extraction of basis heterocyclic nitrogen compounds from petroleum oils using acids is an established technique. However, acidic solvents extract not only nitrogen containing materials from the oil, but can dissolve substantial amounts of nitrogen-free hydrocarbon as well. Nitrogen-free hydrocarbon adsorption by the acid phase constitutes a loss in raffinate yield. Such losses are particularly high when a high percentage of the basic nitrogen present in the feed must be removed. Accordingly, it has been found that a specific two step acid extraction procedure can substantially improve process selectivity and denitrogenated raffinate yield.

Summary of the Invention

This invention relates to a process for the removal of basic heterocyclic nitrogen compounds from petroleum oils which comprises: (a) contacting said petroleum oils containing said basic heterocyclic nitrogen compounds with an aqueous solution of a first solvent comprising concentrated acid in a first extraction zone, (b) separating the product of step (a) into a raffinate product stream comprising hydrocarbons having a lean content of basic heterocyclic nitrogen compound and residual acid levels and a first extract phase comprising hydrocarbons, water and acid and having an increased content of basic heterocyclic nitrogen compounds, (c) flashing said first extract phase to remove acid and water, (d) contacting said flashed first extract phase with an aqueous solution of a second solvent comprising a dilute acid in a second extraction zone, and (e) separating the product of step (d) into a recovery stream comprising hydrocarbons having a lean content of basic heterocyclic nitrogen compounds and a second extract phase comprising acid, water and a decreased amount of nitrogen-free hydrocarbons, and having a high content of basic heterocyclic nitrogen compounds.

It has been found that the process according to the invention results in improved selectivity for removal of nitrogen-containing compounds as well as increased hydrocarbon recovery.

Description of the Preferred Embodiments

Figure 1:
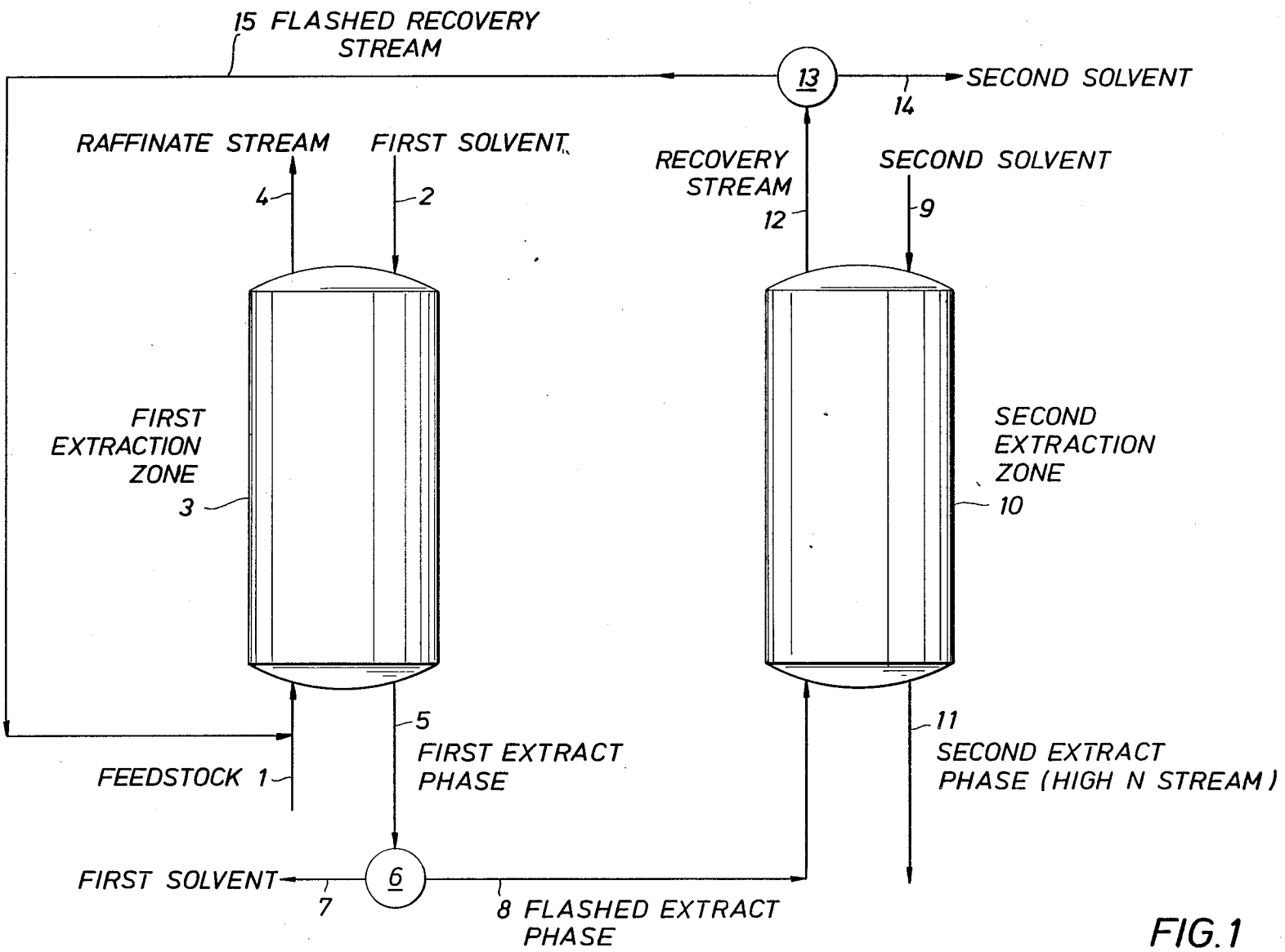
FIG. 1 is a flow diagram of the preferred embodiment of the invention in which the flashed recovery stream resulting from the second extraction is recycled to the first extraction zone.

This invention relates to a process for the removal of basic heterocyclic nitrogen compounds from petroleum oils. In this invention, a two-step heterocyclic nitrogen removal process functions on a crude oil or fraction thereof to extract nitrogen compounds therefrom and to maintain a high recovery of nitrogen-free hydrocarbon from the process. The first step entails extraction with a concentrated acid solvent to remove difficult to extract to heterocyclic nitrogen compounds. The second step entails extraction with an acid solvent more dilute than the concentrated acid solvent used in the first extraction step to improve the selectivity of the extraction process.

The present invention is not concerned with how the petroleum oils having basic heterocyclic nitrogen compounds contained therein are derived. The various fossil fuels may be either crude oils naturally derived from geological sources, distillation fractions of crude oils, or oils previously treated to modify the molecular structure of the fuels. Thus, crude oils from such fields as those west of the Rocky Mountains which are very high in nitrogen compounds, are clearly contemplated to be within the scope of this invention. Also, gas oils and other refinery streams such as fluid catalytic cracking feed material, coker gas oils, vacuum distillate oils, etc., are contemplated to be within the confines of this invention. If desired, the petroleum oil may be distilled or fractionated or hydrotreated in a separation zone prior to extraction to concentrate the problem causing nitrogen compounds into a select special stream, i.e. a distillate bottoms stream. In this manner, a refiner may quickly arrive at a processable stream and concentrate all of the nitrogen-containing compounds into a segregated portion of the refinery.

As used herein, "concentrated acid solvent" means an aqueous solution of an acid having a relatively high acid strength. The term "dilute acid solvent" means an aqueous solution of an acid having an acid strength which is lower than that of the concentrated acid solvent. The acids may be organic or inorganic or mixtures of two or more acids. It is preferred that organic acids be used since inorganic acids have a greater tendency to form emulsions with petroleum oils and therefore require greater separation times.

The extraction agent utilized in the first extraction zone of this two-step extraction process is commonly referred to as a complexing or extraction solvent and comprises an aqueous solution of an acid having a relatively high acid strength. The first extraction step is a conventional process of extraction utilizing a strongly acidic solvent. The strongly acidic or concentrated acid solvent utilized in the first extraction zone will typically be in the range from about 75% by weight to about 99% by weight, preferably about 85% to about 95% by weight of acid, per total weight of solvent. Suitable acids include aliphatic organic carboxylic acids and halogen-substituted carboxylic acids. Typically, carboxylic acids utilized contain 1 to about 15 carbon atoms as exemplified by formic acid, acetic acid, propionic acid, n-butyric acid, isobutyric acid, valeric acid, trimethylacetic acid, caproic acid, n-heptylic acid, caprylic acid, nonanoic acid, decanoic acid, undecanoic acid, dodecanoic acid, tridecanoic acid, tetradecanoic acid, pentadecanoic acid, etc. It is also contemplated that the concentrated acid solvent may be a mixture of two or more acids. It is further contemplated that the aliphatic carboxylic acid be substituted by a moiety chosen from the halogen group of the Periodic Table. Such halogen moieties are one or more of fluoro-, chloro-, bromo-, and iodo-moieties. Exemplary of these substituted carboxylic acids are fluoroacetic acid, chloroacetic acid, bromoacetic acid, iodoacetic acid, dichloroacetic acid, trichloroacetic acid, alpha-chloropropionic acid, beta-chloropropionic acid, trifluoroacetic acid, etc.

The acids utilized in the present invention may be present with an inert co-solvent. This co-solvent is described as being inert in character in that it does not function as a complexing agent for heterocyclic basic hydrogen compound. It is necessary in some cases to have this co-solvent present to facilitate intimate phase contact between the two-phase system of the petroleum oil and the acid solvent. These co-solvents can be considered a mixing means or as an aid to a mixing means. Examples of such inert co-solvents comprise $C_5$ to $C_{10}$ paraffins such as pentane, hexane, heptane, octane, nonane and decane; aromatic hydrocarbons such as benzene, toluene or xylenes; $C_1$ to $C_{10}$ alkanols such as methanol, ethanol, butanol, propanol, pentanol, hexanol, heptanol, octanol, nonanol, decanol, and a naphtha solvent boiling in the range of 120° F. to about 450° F. or even any admixture of the respective co-solvents.

The quantity of concentrated acid solvent necessary to solubilize the heterocyclic basic nitrogen compounds in the first extraction zone varies with different solvents and different feedstocks. In the practice of this invention, it is preferred that at least about 0.1 liter of concentrated acid solvent be present for each liter of petroleum oil treated. Most preferably, about 0.2 to about 3.0 liters of concentrated acid solvent per liter of petroleum oil treated will be present in the extraction zone having two phases contained therein. It is of course possible that a larger amount of the concentrated acid solvent can be utilized than is necessary to adequately solubilize the heterocyclic basic nitrogen compounds. However, when an excessive amount of concentrated acid solvent is utilized, the selectivity of the extraction process is diminished.

The first step of the process of this invention concerns a two-phase system for complexing and extracting the heterocyclic basic nitrogen compounds entrained in a petroleum oil. One phase is a petroleum oil containing the heterocylic basic nitrogen compounds while the second phase is an aqueous phase having a concentrated acid dissolved therein. The quantity of water in the aqueous phase must be sufficient to insure creation and maintenance of a two phase system, that is to say, to insure that the phases remain immiscible. The concentration of the acid in the aqueous phase in the first extraction zone will be from about 75 to about 99 weight percent.

The amount and type of heterocyclic basic nitrogen compounds is ascertained by a chemical analysis of a sample of the applicable petroleum oil or fraction of the petroleum oil. While not wishing to be bound by any specific heterocyclic basic nitrogen compound, it is believed that the most prevelant nitrogen compounds in petroleum oils are those in which the nitrogen atom is contained in a 5-membered or 6-membered ring, the rings being either unsaturated or saturated.

The extraction conditions utilized in the first extraction zone include a temperature ranging from ambient to about 300° F., and a pressure ranging from 1 atmosphere to about 20 atmospheres. A preferred range of extraction conditions includes a temperature of from about 70° F. to about 180° F. and a pressure of from about 1 atmospheres to about 2 atmospheres. A most preferred range of extraction conditions include a temperature of from about 120° F. to about 160° F., and a pressure of about 1 atmosphere. The extraction section utilized in this invention can be any conventional solvent extraction equipment which provides a mixing means for adequate intermixture of the two-phase system. Such contactors are commonplace in the art and are exemplified by such apparatus as a mixer-settler, a rotating disc contactor, a pulsating column, and the like. Addition means are also provided for the entry of extractant into the extraction zone. This means can comprise any type of valve or conduit which provides ready access to the interior of the extraction zone. The addition means can be constructed to pass new extractant, new and recycle extractant, or only recycle extractant to the first extraction zone.

Following the mixing of acid solvent and oil and the subsequent formation of distinct phases in the first contactor, the phases are physically separated. The upper phase is a raffinate product stream which consists primarily of hydrocarbon, with some basic nitrogen material plus residual levels of acid present. This phase is flashed at a temperature above the boiling point of the acid but below the initial boiling point of petroleum oil, resulting in a raffinate product stream from which basic nitrogen has been depleted. If desired, this denitrogenated raffinate product stream is suitable for further processing by, for example, a catalytic cracker.

The lower phase is a first extract phase and consists of acid solvent, protonated basic nitrogen materials and dissolved hydrocarbons and thus constitutes a loss in the volume of the raffinate product stream. The extract phase is flashed at a temperature above the boiling point of the acid solvent but below the initial boiling point of the extracted materials. The flashed extract phase is then passed to a second extraction zone.

The second process step of this invention concerns a two-phase system for extracting the heterocyclic basic nitrogen compounds from the extract phase from the first extraction zone. In this second process step, the extract phase is contacted in a second extraction zone with an acid solvent more dilute than that utilized in the first extraction zone. Suitably, the acid solvent in the second extraction zone will have a concentration ranging from about 10% to about 80% by weight, preferably from about 25% to about 75% by weight and more preferably from about 50% to about 70% by weight of acid, per total weight of solvent. As in the first extraction zone, the conditions utilized in the second extraction zone include a temperature ranging from ambient to 300° F. and a pressure ranging from 1 atmosphere to about 20 atmospheres. A preferred range of extraction condition includes a temperature of from about 70° F. to about 180° F. and a pressure of from about 1 atmospheres to about 2 atmospheres, with a most preferred range of extraction conditions being a temperature of from about 120° F. to about 160° F., and a pressure of about 1 atmosphere.

In the second extraction zone, it is preferred that at least about 0.5 liters of dilute acid solvent be present for each liter of heterocyclic basic nitrogen compound present in the extract stream. Most preferably, at least about 2 to about 5 liters of dilute acid solvent per liter of the heterocyclic basic nitrogen compound will be present in second extraction zone.

Following contacting and phase coalescence in the second extraction zone, the product is separated into a recovery stream which is then flashed to remove acid and water, and a second extract phase.

The recovery stream from the second extraction zone contains a substantially higher fraction of hydrocarbons and lower fraction of basic nitrogen materials than does the extract from the first extraction zone. In a preferred embodiment, the recovery stream is recycled by adding it to the petroleum oil which is scheduled to be extracted in the first extraction zone. In a second embodiment, the recovery product stream is combined with the denitrogenated raffinate stream from the first extraction zone and passed to a catalytic cracker or other refinery unit for further processing. Although the recovery stream from the second extraction has a higher basic nitrogen level than does the raffinate stream from the first extraction zone, its volume is typically less than about 5% of the product raffinate stream from the first extraction zone. Thus, passing the recovery stream along with the product raffinate stream from the first extraction zone to the catalytic cracker would substantially improve the selectivity of the overall process, with the net removal of basic nitrogen being only slightly reduced. The extract phase which results from the second extraction zone has an increased basic nitrogen content and a diminished nitrogen-free oil content, as compared with the extract phase from the first extraction zone. Thus, the result of the second extraction step is a substantial improvement in the overall raffinate yield of the process. While not wishing to be bound by any particular theory, it is believed that the improvement in raffinate yield occurs because the relative solubility of protonated basic nitrogen material versus nitrogen-free hydrocarbon material is greater in a dilute acid solvent than in a concentrated acid solvent.

The two-step process of the instant invention is therefore superior to a single- step extraction with concentrated acid solvent because the selectivity of the two-step process is higher. Higher selectivity is equivalent to a higher yield of denitrogenated product raffinate.

The two-step process of the instant invention is also superior to a single-step extraction with dilute acid solvent because dilute acid treatment of a bulk feedstock generally cannot achieve deep removal of basic nitrogen. Further, a much larger volume of dilute acid is required to remove a given amount of basic nitrogen from a feedstock, as compared to the volume of concentrated acid required to remove the same amount of basic nitrogen from the same feedstock. Reduced solvent volume translates directly into reduced capital and operating expenses.

Detailed Description of the Drawings

While not wishing to be bound by any specific flow scheme herein, FIG. 1 is representative of the preferred embodiment of this invention. Fresh petroleum oil having a high content of nitrogen compounds is added through conduit 1 to first extraction zone 3. If desirable, fresh oil feed in conduit 1 may be heated in a heating zone (not shown) prior to addition to extraction in first extraction zone 3. If desired, a distillation step may be performed on the fresh oil feed and only a portion passed to first extraction zone 3. In extraction zone 3, two phases are formed. A first phase comprises a raffinate stream from which heterocyclic nitrogen compounds have been extracted by means of a first concentrated acid solvent which is added to extraction zone 3 through conduit 2. The two phases formed in extraction zone 3 are removed as raffinate stream 4 and first extract phase 5. Each is treated differently, derivative of their make up. Raffinate stream 4 contains petroleum oil having a reduced quantity of heterocyclic nitrogen compounds compared to the fresh feed oil. The raffinate stream 4 may be passed, for example, to a catalytic cracker for further processing. It may be desirable to separate dissolved solvent from the raffinate stream by flashing, prior to downstream use. The first extract phase 5 is flashed in flashing zone 6 to remove bulk first solvent, which is passed out of the system to recycle through conduit 7. The flashed first extract phase 8 is then passed into second extraction zone 10. In second extraction zone 10, two phases are formed. A first phase comprises a recovery stream 12 from which heterocyclic nitrogen compounds have been extracted by means of a second solvent 9 which comprises a dilute acid solvent. The second extract phase 11, a stream having a high nitrogen compounds content is removed from second extraction zone 10. This stream would be flashed to recover and recycle the second solvent contained in the stream, prior to utilization of the extract. The recovery stream 12 is removed from second extract zone 10 and flashed in flashing zone 13 to remove the second solvent. The second solvent is removed from the system to recycle via conduit 14. The flashed recovery stream 15 is then combined with fresh oil feedstock in conduit 1 and recycled to first extract zone 3 for further processing.

Figure 2:
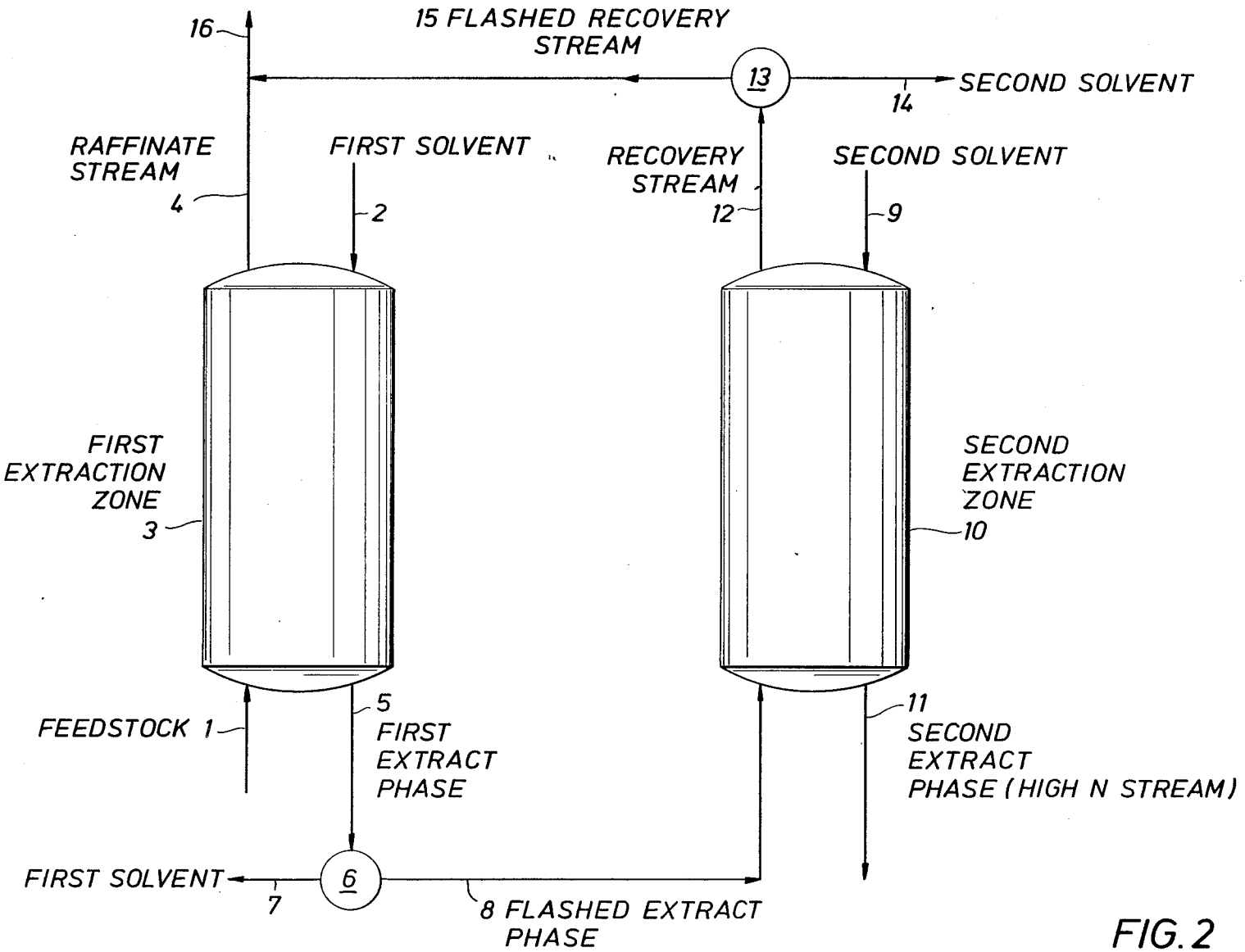
FIG. 2 is a flow diagram of a second embodiment of the invention in which the flashed recovery stream resulting from the second extraction zone is combined with the raffinate product stream from the first extraction and passed to a catalytic cracker.

FIG. 2 is representative of another embodiment of this invention. The process in FIG. 2 differs from that illustrated in FIG. 1 in that the flashed recovery stream 15 is combined with raffinate stream 4 and passed, for example, to a catalytic cracker for further processing downstream through conduit 16 rather than being recycled as in the embodiment illustrated in FIG. 1.

Illustrative Embodiments

The illustrative embodiment described herein is exemplary of this process and is not given to having a limiting effect upon the claims hereinafter presented.

EXAMPLE 1

Example 1 illustrates the embodiment of the invention depicted in FIG. 2. In this example, a hydrotreated vacuum gas oil feedstock having the properties listed in Table 1 was contacted with a volume of 90% acetic acid using a solvent/oil volume ration of 1.5/1 at 60° C. The phases were then allowed to separate. The raffinate phase was flashed at a temperature well below the initial boiling point of the feedstock but well above the boiling point of water and acetic acid to remove residual acid in water. The resulting flashed material constituted the first recovery stream of denitrogenated raffinate product. Removal of basic nitrogen from the feedstock was efficient; the basic nitrogen of the oil was reduced from 1492 ppm to 228 ppm (85% removal). The acid extract phase which contained dissolved basic nitrogen compounds and dissolved nitrogen-free hydrocarbons in addition to acid and water was also flashed. The resulting flashed extract phase was analyzed and found to exhibit a basic nitrogen level of 14690 ppm. The raffinate yield of the process, that is to say the weight of denitrogenated raffinate recovered divided by the weight of feedstock treated, was 91.8 %w. The extract stream was then subjected to a second extraction treatment with 70% acetic acid at a solvent/oil volume ratio of 4/1. The resulting recovery stream Phase was flashed to remove acid and water and found to contain 6800 ppm basic nitrogen. This material contains a substantially higher fraction of hydrocarbons and a lower fraction of basic nitrogen materials than did the extract from the first extraction. This second recovery stream phase was added to the denitrogenated raffinate product from the first extraction zone to comprise the total raffinate product for the two-step process. The acid or extract phase resulting from the second extraction was flashed to remove acid and water and then analyzed. The extract contained 34,700 ppm basic nitrogen. Thus, the extract phase from the first contacting step had been substantially concentrated in its basic nitrogen content by the second extraction step. The results are presented in Table 2.

The combined two-step extraction achieved deep basic nitrogen removal from the feedstock (902 ppm) although not as deep as the single-step extraction (1264 ppm). Had the recovery stream from the second extraction been utilized in the recycle mode, i.e., as is described by FIG. 1, the two-step extraction would have achieved an even higher degree of basic nitrogen removal.

Of greatest significance is the observed increase in raffinate yield from 91.8 %w for the single-step extraction to 97.2%w for the two-step extraction. Thus, raffinate yield loss was decreased from 8.2 %w to only 2.8 %w.

As can be seen in Table 2, the two-step process gives a tremendous improvement in raffinate yield (i.e., raffinate yield loss is cut to approximately ⅓ of loss in one-step process). It can also be seen that even in non-recycle mode (FIG. 2), basic nitrogen removal is diminished only to a modest extent, whereas in recycle mode (FIG. 1), it is postulated that basic nitrogen removal would be almost as good as the one-step process in the non-cycle mode.

TABLE 1

| Feedstock Properties | |
|---|---|
| Feed Type | Lightly Hydrotreated West Coast Vacuum Gas Oil Blend |
| Basic Nitrogen | 1492 ppm |
| Total Nitrogen | 4017 ppm |
| Sulfur | 0.20% w |

TABLE 1-continued

| Feedstock Properties | |
|---|---|
| Feed Type | Lightly Hydrotreated West Coast Vacuum Gas Oil Blend |
| Aromatics | 17.0% w |
| Density (60° F.) | 0.943 g/cc |

TABLE 2

Performance Comparison of Two-Step Extraction Versus Single-Step Extraction (No Recycle)

| Extraction Procedure | Feedstock Basic Nitrogen (ppm) | Product Basic Nitrogen (ppm) | Basic Nitrogen Removed (ppm) | Raffinate Yield Loss (% w) |
|---|---|---|---|---|
| Single-Step | 1492 | 228 | 1264 | 8.2% |
| Two-Step | 1492 | 590 | 902 | 2.8% |

*Raffinate Yield Loss = 100% − Raffinate Yield

What is claimed is:

1. A process for the removal of basic heterocyclic nitrogen compounds from petroleum oils which comprises:

(a) contacting said petroleum oils containing basic heterocyclic nitrogen compounds with an aqueous solution of a first solvent comprising concentrated acid at extraction conditions in a first extraction zone, (b) separating the product of step (a) into a raffinate product stream comprising hydrocarbons having a lean content of basic heterocyclic nitrogen compounds and residual acid levels, and a first extract phase comprising hydrocarbons, water and acid having a substantial content of basic heterocyclic nitrogen compounds, (c) flashing said first extract phase to remove bulk first solvent, (d) contacting said flashed first extract stream with an aqueous solution of a second solvent comprising a dilute acid at extraction conditions in a second extraction zone, and (e) separating the product of step d) into a recovery stream comprising hydrocarbons having a lean content of basic heterocyclic nitrogen compounds and a second extract phase comprising acid, water and a decreased amount of hydrocarbons, and having a high content of basic heterocyclic nitrogen compounds.

2. The process of claim 1 wherein said first solvent has an acid concentration in the range of from about 75.0% by weight to about 99.0% by weight, per total weight of solvent.

3. The process of claim 2 wherein said first solvent has an acid concentration in the range of from about 85.0% by weight to about 95.0% by weight, per total weight of solvent.

4. The process of claim 1 wherein first solvent comprises an acid selected from the group consisting of aliphatic organic carboxylic acids, halogen-substituted carboxylic acids and mixtures thereof.

5. The process of claim 1 wherein said second solvent has an acid concentration in the range of from about! 0.0% by weight to about 80.0% by weight, per total weight of solvent.

6. The process of claim 5 wherein said second solvent has an acid concentration in the range of from about 25.0% by weight to about 75.0% by weight, per total weight of solvent.

7. The process of claim 1 wherein said second solvent comprises an acid selected from the group consisting of aliphatic organic carboxylic acids, halogen-substituted carboxylic acids and mixtures thereof.

8. The process of claim 1 wherein said extraction conditions include a temperature in the range of from ambient temperature to about 300° F. and a pressure in the range of from about 1 atmosphere to about 20 atmospheres.

9. The process of claim 1 wherein said recovery stream in step (e) is combined with said petroleum oils in step (a) and recycled.

10. The process of claim 1 wherein said recovery stream in step (e) is combined with said raffinate product stream from step (b) and passed downstream for further processing.

11. A process for the removal of basic heterocyclic nitrogen compounds from petroleum oils which comprises:

(a) contacting said petroleum oils containing basic heterocyclic nitrogen compounds with an aqueous solution of a first solvent comprising concentrated acid having an acid concentration in the range of from about 75.0% by weight to about 99.0% by weight, per total weight of solvent, at extraction conditions in a first extraction zone, (b) separating the product of step (a) into a raffinate product stream comprising hydrocarbons having a lean content of basic heterocyclic nitrogen compounds and residual acid levels, and a first extract phase comprising hydrocarbons, water and acid having a substantial content of basic heterocyclic nitrogen compounds, (c) flashing said first extract phase to remove bulk first solvent, (d) contacting said flashed first extract stream with an aqueous solution of a second solvent comprising a dilute acid at extraction conditions in a second extraction zone, and (e) separating the product of step (d) into a recovery stream comprising hydrocarbons having a lean content of basic heterocyclic nitrogen compounds and a second extract phase comprising acid, water and a decreased amount of hydrocarbons, and having a high content of basic heterocyclic nitrogen compounds.

12. The process of claim 11 wherein said first solvent has an acid concentration in the range of from about 85.0% by weight to about 95.0% by weight, per total weight of solvent.

13. The process of claim 11 wherein first solvent comprises an acid selected from the group consisting of aliphatic organic carboxylic acids, halogen-substituted carboxylic acids and mixtures thereof.

14. The process of claim 11 wherein said second solvent has an acid concentration in the range of from about 10.0% by weight to about 80.0% by weight, per total weight of solvent.

15. The process of claim 14 wherein said second solvent has an acid concentration in the range of from about 25.0% by weight to about 75.0% by weight, per total weight of solvent.

16. The process of claim 11 wherein said second solvent comprises an acid selected from the group consisting of aliphatic organic carboxylic acids, halogen-substituted carboxylic acids and mixtures thereof.

17. The process of claim 11 wherein said extraction conditions include a temperature in the range of from ambient temperature to about 300° and a pressure in the range of from about 1 atmosphere to about 20 atmospheres.

18. The process of claim 11 wherein said recovery stream in step (e) is combined with said petroleum oils in step (a) and recycled.

19. The process of claim 11 wherein said recovery stream in step (e) is combined with said raffinate product stream from step (b) and passed downstream for further processing.

20. A process for the removal of basic heterocyclic nitrogen compounds from petroleum oils which comprises:

(a) contacting said petroleum oils containing basic heterocyclic nitrogen compounds with an aqueous solution of a first solvent comprising concentrated acid wherein said acid is selected from the group consisting of aliphatic organic carboxylic acids, halogen-substituted carboxylic acids and mixtures thereof, at extraction conditions in a first extraction zone.

(b) separating the product of step (a) into a raffinate product stream comprising hydrocarbons having a lena content of basic heterocyclic nitrogen compounds and residual acid levels, and a first extract phase comprising hydrocarbons, water and acid having a substantial content of basic heterocyclic nitrogen compounds, (c) flashing said first extract phase to remove bulk first solvent, (d) contacting said flashed first extract stream with an aqueous solution of a second solvent comprising a dilute acid at extraction conditions in a second extraction zone, and (e) separating the product of step (d) into a recovery stream comprising hydrocarbons having a lean content of basic heterocyclic nitrogen compounds and a second extract phase comprising acid, water and a decreased amount of hydrocarbons, and having a high content of basic heterocyclic nitrogen compounds.

21. The process of claim 21 wherein said first solvent has an acid concentration in the range of from about 75.0% by weight to about 99.0% by weight, per total weight of solvent.

22. The process of claim 21 wherein said first solvent has an acid concentration in the range of from bout 85.0% by weight to about 95.0% by weight, per total weight of solvent.

23. The process of claim 21 wherein said second solvent has an acid concentration in the range of from about 10.0% by weight to about 80.0% by weight, per total weight of solvent.

24. The process of claim 23 wherein said second solvent has an acid concentration in the range of from about 25.0% by weight to about 75.0% by weight, per total weight of solvent.

25. The process of claim 21 wherein said second solvent comprises an acid selected from the group consisting of aliphatic organic carboxylic acids, halogen-substituted carboxylic acids and mixtures thereof.

26. The process of claim 21 wherein said extraction conditions include a temperature in the range of from ambient temperature to about 300° F. and a pressure in the range of from about 1 atmosphere to about 20 atmospheres.

27. The process of claim 21 wherein said recovery stream in step (e) is combined with said petroleum oils in step (a) and recycled.

28. The process of claim 21 wherein said recovery stream in step (e) is combined with said raffinate product stream from step (b) and passed downstream for further processing.

* * * * *